US006848423B2

(12) United States Patent
Schmidl et al.

(10) Patent No.: US 6,848,423 B2
(45) Date of Patent: Feb. 1, 2005

(54) FUEL INJECTION SYSTEM FOR AN INTERNAL COMBUSTION ENGINE

(75) Inventors: Matthias Schmidl, Gries (AT); Thomas Lettner, Adnet (AT); Robert Reitsam, Hallein (AT)

(73) Assignee: Robert Bosch GmbH, Stuttgart (DE)

( * ) Notice: Subject to any disclaimer, the term of this patent is extended or adjusted under 35 U.S.C. 154(b) by 49 days.

(21) Appl. No.: 10/251,877

(22) Filed: Sep. 23, 2002

(65) Prior Publication Data

US 2004/0007214 A1 Jan. 15, 2004

(30) Foreign Application Priority Data

Sep. 22, 2001 (DE) ..... 101 46 740

(51) Int. Cl.[7] ..... F02M 37/04
(52) U.S. Cl. ..... 123/446; 123/458
(58) Field of Search ..... 123/446, 457–8, 123/496; 417/286, 288

(56) References Cited

U.S. PATENT DOCUMENTS 4,643,155 A * 2/1987 O'Neill ..... 123/506
4,884,545 A * 12/1989 Mathis ..... 123/447
5,884,606 A * 3/1999 Kellner et al. ..... 123/446
5,927,322 A * 7/1999 Rosenau ..... 137/487.5
5,971,718 A * 10/1999 Krueger et al. ..... 417/286
6,024,064 A 2/2000 Kato et al.
6,142,747 A * 11/2000 Rosenau et al. ..... 417/251
6,253,734 B1 * 7/2001 Rembold et al. ..... 123/446
2003/0136384 A1 * 7/2003 Linden et al. ..... 123/458

FOREIGN PATENT DOCUMENTS

| | | |
|---|---|---|
| DE | 198 53 103 A1 | 5/2000 |
| EP | 0 270 720 A1 | 6/1988 |
| EP | 0 299 337 A2 | 1/1989 |
| WO | WO 98/51921 | 11/1998 |

* cited by examiner

*Primary Examiner*—Thomas Moulis
(74) *Attorney, Agent, or Firm*—Ronald E. Greigg

(57) ABSTRACT

A fuel injection system having a fuel reservoir, a high-pressure fuel pump by which fuel is pumped into the fuel reservoir as a function of engine operating parameters, a prefeed pump by which fuel is pumped from a fuel tank to the intake side of the high-pressure fuel pump, a fuel metering device for adjusting the fuel quantity pumped into the fuel reservoir by the high-pressure fuel pump, and at least one injector, communicating with the fuel reservoir, for fuel injection to the engine. The metering device is disposed between the fuel tank and the intake side of the prefeed pump. The high-pressure fuel pump has a drive region, which for the sake of its lubrication can be made to communicate with the outlet of the prefeed pump, via a pressure valve that opens towards the drive region.

20 Claims, 4 Drawing Sheets

FUEL INJECTION SYSTEM FOR AN INTERNAL COMBUSTION ENGINE

BACKGROUND OF THE INVENTION

1. Field of the Invention

The invention is directed to an improved fuel injection system for an internal combustion engine.

2. Description of the Prior Art

One fuel injection system known from German Patent Disclosure DE 198 53 103 A1 has a fuel reservoir and a high-pressure fuel pump, by which fuel is pumped into the fuel reservoir as a function of engine operating parameters. A prefeed pump is also provided, by which fuel is pumped out of a fuel tank to the intake side of the high-pressure fuel pump. A fuel metering device is also provided, for controlling the fuel quantity pumped into the fuel reservoir by the high-pressure fuel pump. The fuel metering device is disposed between the prefeed pump and the high-pressure fuel pump, so that by it, the fuel quantity pumped by the prefeed pump and delivered to the intake side of the high-pressure fuel pump is adjusted. Excess fuel quantity pumped by the prefeed pump is returned to the intake side of the prefeed pump. As a result, although the requisite drive power for the high-pressure fuel pump is limited because the high-pressure fuel pump pumps only the fuel quantity actually required into the reservoir, nevertheless, as a rule the prefeed pump pumps an excessive fuel quantity, which is returned again. This requires high drive power for the prefeed pump, and the fuel pumped is severely heated. Moreover, the fuel metering device is subjected to the pressure generated by the prefeed pump and must be correspondingly complicatedly sealed off.

OBJECT AND SUMMARY OF THE INVENTION

The fuel injection system of the invention has the advantage over the prior art that the drive power required for the prefeed pump can be reduced, and severe heating of the fuel does not occur, since only the fuel quantity required is pumped by the prefeed pump. Moreover, the metering device is not subjected to the pressure generated by the prefeed pump and can therefore be sealed off less complicatedly.

Advantageous features of and refinements to the fuel injection system of the invention are achieved in various embodiments. One embodiment of the invention assures a diversion of fuel in the event that the inlet to the prefeed pump cannot be blocked completely by the fuel metering device. Another embodiment assures lubrication to the drive region of the high-pressure fuel pump, without reducing the fuel quantity delivered to the high-pressure fuel pump, especially upon starting of the engine. A further embodiment assures that for lubricating the drive region, only a small proportion of the fuel quantity pumped by the prefeed pump is diverted. Yet another embodiment also makes it possible to lubricate the drive region of the high-pressure fuel pump.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
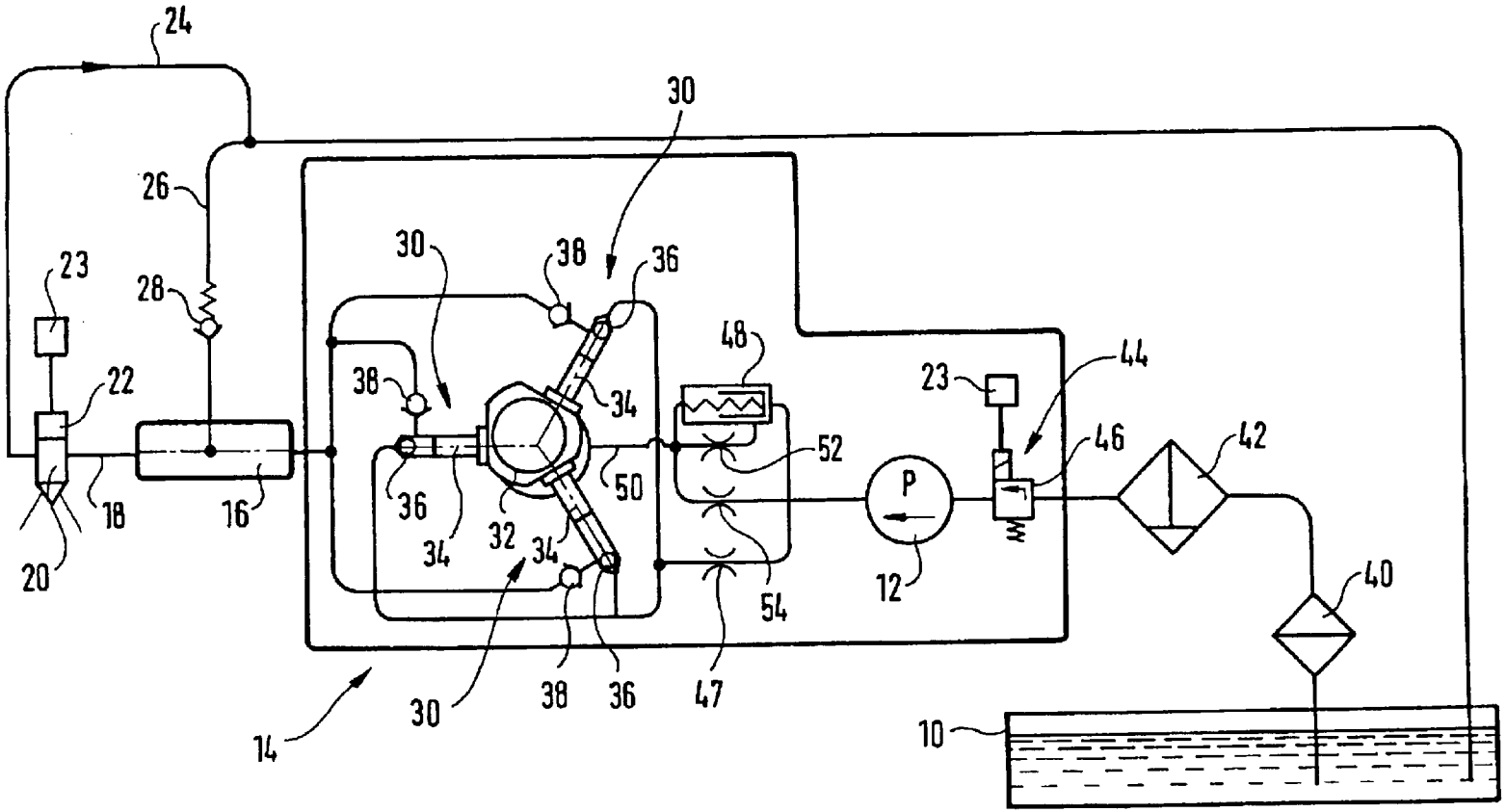
FIG. 1 schematically shows a fuel injection system for an internal combustion engine, in accordance with a first exemplary embodiment.

FIGS. 1–4 show a fuel injection system for an internal combustion engine, for instance in a motor vehicle. The engine is preferably a self-igniting engine and has one or more cylinders. The motor vehicle has a fuel tank 10, in which fuel is kept on hand for operating the engine. The fuel injection system has a prefeed pump 12, by which fuel is pumped from the fuel tank to a high-pressure fuel pump 14. The high-pressure fuel pump 14 pumps fuel into a fuel reservoir 16, which may be embodied in tubular form, for instance, or in some arbitrary other shape. From the fuel reservoir 16, lines 18 lead to injectors 20 disposed at the cylinders of the engine. At each of the injectors 20, a respective electric control valve 22 is disposed, by which an opening of the injectors is controlled, in order to bring about, or prevent, an injection of fuel through the respective injector 20. The control valves 22 are triggered by an electronic control unit 23, by which the instant and duration of fuel injection through the injectors 20 is determined as a function of engine operating parameters, such as rpm, load, temperature, and others. From the injectors 20, a return for unused fuel leads at least indirectly back into the fuel tank 10, for instance via one common line 24 for all the injectors. From the fuel reservoir 16, a line 26 can also return to the fuel tank 10; a pressure limiting valve 28 is disposed in this line, to prevent an excessively high pressure from building up in the fuel reservoir 16.

The high-pressure fuel pump 14 is driven mechanically by the engine and thus in proportion to the engine rpm. The prefeed pump 12 can also be driven mechanically by the engine, and a common drive shaft can be provided for both the high-pressure fuel pump 14 and the prefeed pump 12. Alternatively, the prefeed pump 12 can have an electric-motor drive, for instance.

The high-pressure fuel pump 14 is embodied as a radial piston pump and has a plurality of pump elements 30, for instance three, spaced apart at uniform angles from one another, which each have one pump piston 34, driven in a reciprocating motion by a camshaft 32, and each pump piston defines one pump work chamber 36. During a given intake stroke of the pump pistons 34, when they move radially inward, the pump work chambers 36 communicate with the outlet from the prefeed pump 12 and are filled with fuel, while the pump work chambers 36 are disconnected from the fuel reservoir 16. During a given supply stroke of the pump pistons 34, when they are moving radially outward, the pump work chambers 36 communicate with the fuel reservoir 16 and are disconnected from the outlet of the prefeed pump 12. In each of the connections of the pump work chambers 36 with the fuel reservoir 16, a respective check valve 38 opening toward the fuel reservoir 16 is provided, by means of which the disconnection between the pump work chambers 36 and the fuel reservoir 16 in the intake stroke of the pump pistons 34 is brought about. Both the camshaft 32 and the pump piston 34 that engage its cams form a drive region of the high-pressure fuel pump 14. The pump pistons 34 can engage the cams of the camshaft 32 either directly or via tappets.

One or more filters are preferably disposed between the prefeed pump 12 and the fuel tank 10. For instance, beginning at the fuel tank 10, there can be first a coarse filter 40 and downstream of it a fine filter 42, and the fine filter 42 can additionally have a water separator.

Between the fuel tank 10 and the prefeed pump 12, and in particular between the fine filter 42 and the prefeed pump 12, there is a fuel metering device 44. The fuel metering device 44 has a regulating valve 46 actuated electrically and in particular electromagnetically, by which the flow from the fuel tank 10 to the prefeed pump 12 is adjusted. The fuel metering device 44 is also triggered by the control unit 23, in such a way that the prefeed pump 12 pumps a fuel quantity and delivers it to the high-pressure fuel pump 14, and this quantity is then in turn pumped by the high-pressure fuel pump 14 at high pressure into the fuel reservoir 16, in order to maintain a predetermined pressure, dependent on engine operating parameters, in the fuel reservoir 16. By means of the fuel metering device 44, the flow from the fuel tank 10 to the prefeed pump 12 can be blocked entirely, opened entirely, or opened with a partly opened flow cross section. Opening a partial flow cross section by means of the fuel metering device 44 can be attained by triggering this fuel metering device in clocked, pulse width modulated fashion, the size of the opened flow cross section being dependent on the pulse width. A fuel metering device 44 of this kind is known for instance from DE 198 53 103 A1 mentioned above, which is hereby incorporated in its entirety by reference.

The inflow from the prefeed pump 12 to the pump work chambers 36 of the high-pressure fuel pump 14 takes place via a manifold or lines, which act as a throttle restriction 47, by which a pressure drop dependent on the fuel quantity flowing through per unit of time is brought about.

In a first exemplary embodiment of the fuel injection system, shown in FIG. 1, parallel to the manifold or lines having the throttle restriction 47, there is a pressure valve 48, by which an inlet 50 to the drive region of the high-pressure fuel pump 14 including the camshaft 32 is controlled. If the predetermined opening pressure of the pressure valve 48 is exceeded by the prefeed pump 12, then the pressure valve 48 opens and uncovers the inlet 50, so that fuel reaches the drive region including the camshaft 32 and assures adequate lubrication there. Downstream of the pressure valve 48, a throttle restriction 52 is provided in the inlet and limits the flow through the inlet, so that excess fuel quantity will not be diverted to the drive region of the high-pressure pump 14. Upon starting of the engine, a slight fuel quantity, which is required for the pressure buildup in the fuel reservoir 16 and for the fuel injection, is still pumped by the prefeed pump 12 and by the high-pressure fuel pump 14, the latter being driven as a function of rpm. During this time, the pressure valve 48 is closed, so that no fuel quantity for lubricating the high-pressure fuel pump 14 is diverted; instead, all the fuel quantity pumped by the prefeed pump 12 flows to the high-pressure fuel pump 14. By means of the pressure valve 48 and the throttle restriction 52, venting is made possible as well, in the event that the prefeed pump 12 initially pumps air.

Parallel to the pressure valve 48, the inlet 50 can also communicate with the prefeed pump 12 via a further throttle restriction 54, by way of which the drive region of the high-pressure fuel pump 14 has a constantly open communication with the prefeed pump 12. The drive region of the high-pressure fuel pump 14 then forms a relief region, and this communication serves to provide that a fuel quantity, that is, the fuel quantity still pumped by the prefeed pump 12 in the event of possible leaks in the metering device 44, in other words, if the metering device is unable to completely block the flow from the fuel tank 10 to the prefeed pump 12, will not be delivered to the pump work chambers 36 and also serves to assure adequate lubrication of the drive region of the high-pressure fuel pump 14, even if, because of low fuel demand by the engine, actually no fuel needs to be pumped by the high-pressure fuel pump 14 and the prefeed pump 12. This is the case for instance in the overrunning mode of the engine.

The high-pressure fuel pump 14, prefeed pump 12, pressure valve 48, inlet 50, throttle restriction 52, throttle restriction 54, and fuel metering device 44 are preferably assembled in a common structural unit.

Figure 2:
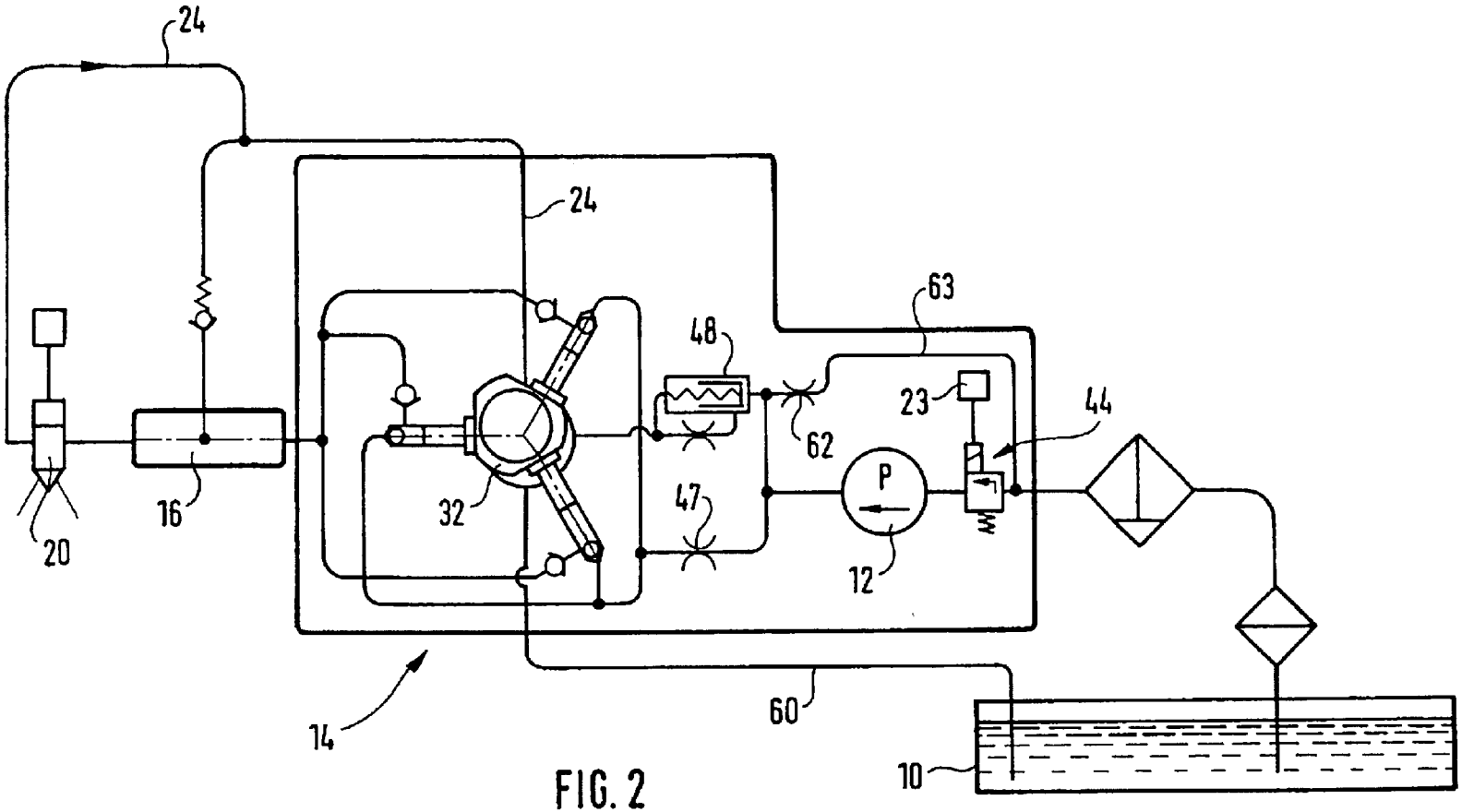
FIG. 2 schematically shows a fuel injection system for an internal combustion engine, in accordance with a second exemplary embodiment.

In FIG. 2, the fuel injection system in a second exemplary embodiment is shown. Identical elements are identified by the same reference numerals as in the first exemplary embodiment, and essentially only the characteristics that differ from the first exemplary embodiment will be explained below. The return 24 from the injectors 20, in the second exemplary embodiment, is not carried directly into the fuel tank 10 but instead discharges into the drive region of the high-pressure fuel pump 14 including its camshaft 32 and thus communicates to the lubrication of this region. From the drive region, a line 60 also leads away to the fuel tank 10. In addition, the pressure valve 48 already described in the first exemplary embodiment can be provided, so that for lubricating the control valve of the high-pressure fuel pump 14, both the fuel quantity flowing through the return 24 from the injectors 20 and the fuel quantity controlled by the pressure valve 48 are available. If the engine consumes only a slight fuel quantity, as is the case for instance during idling or at low load, then the fuel flowing back from the injectors 20 through the return 24 has a relatively low temperature. At high engine fuel consumption, the fuel flowing back from the injectors 20 through the return 24 has a high temperature. If the pressure valve 48 is provided, however, then fuel is also delivered at relatively low temperature to the drive region of the high-pressure fuel pump 14 and mixes with the fuel flowing through the return 24, so that only slight heating of the high-pressure fuel pump 14 occurs. Moreover, the fuel flowing back from the injectors 20 through the return 24 assures lubrication of the drive region of the high-pressure fuel pump 14 even in the event that no fuel, or only a slight fuel quantity, is pumped by the prefeed pump 12, and the pressure valve 48 does not open.

In the fuel injection system of the second exemplary embodiment, a further throttle restriction 62 can also be provided on the outlet side of the prefeed pump 12. The throttle restriction 62 can be disposed in a connection with a return to the fuel tank 10 as a relief region, or in a connection with the drive region of the high-pressure fuel pump 14 as a relief region, as is the case in the first exemplary embodiment, or, as shown in FIG. 2, in a connection 63 returning to the intake side of the prefeed pump 12, as a relief region. If a complete blockage of the flow from the fuel tank 10 to the prefeed pump 12 is assured by the fuel metering device 44, then it is also possible to omit the connection with the throttle restriction 62 to a relief region.

Figure 3:
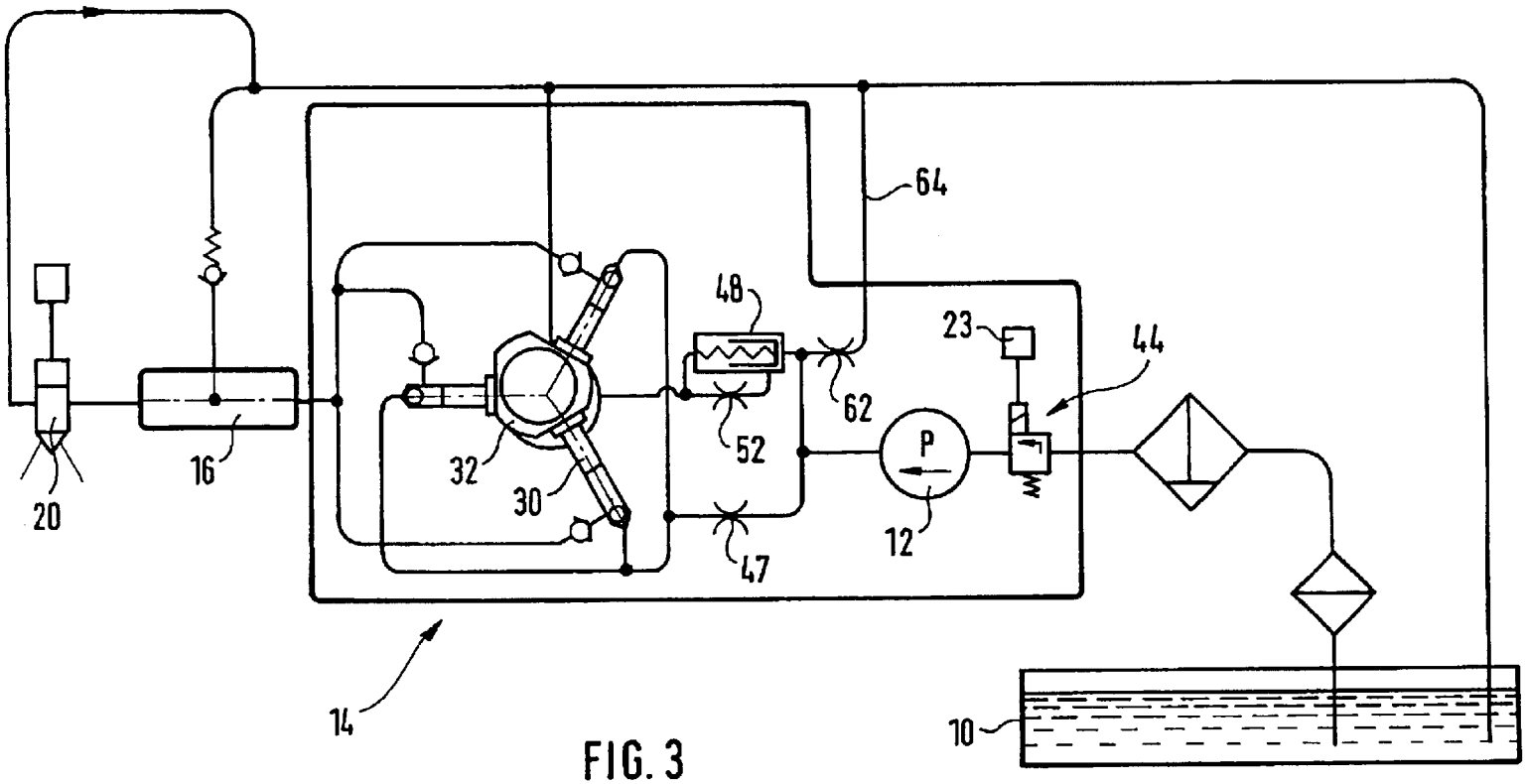
FIG. 3 schematically shows a fuel injection system for an internal combustion engine, in accordance with a third exemplary embodiment.

In FIG. 3, the fuel injection system is shown in a third exemplary embodiment. Once again, identical elements are identified by the same reference numerals as in the first exemplary embodiment, and below, essentially only the characteristics that differ from the first exemplary embodiment will be explained. For lubricating the drive region of the high-pressure fuel pump 14, as in the first exemplary embodiment, the pressure valve 48 with the downstream throttle restriction 52 is provided. In the event that the prefeed pump 12 is not pumping any fuel or is pumping only a slight fuel quantity and the pressure valve 48 is not open, lubrication of the drive region of the high-pressure fuel pump 14 can be assured by means of the fuel that accumulates there. Fuel can also reach the drive region through leaks that may exists in the pump elements 30. In the event that the inlet to the prefeed pump 12 cannot be blocked completely by the fuel metering device 44, then once again the communication with a relief region having the further throttle restriction 62 may be provided, which as shown in FIG. 3 can be disposed in a connection 64 to a return into the fuel tank 10, or as in the second exemplary embodiment, in a connection with the intake side of the prefeed pump 12.

Figure 4:
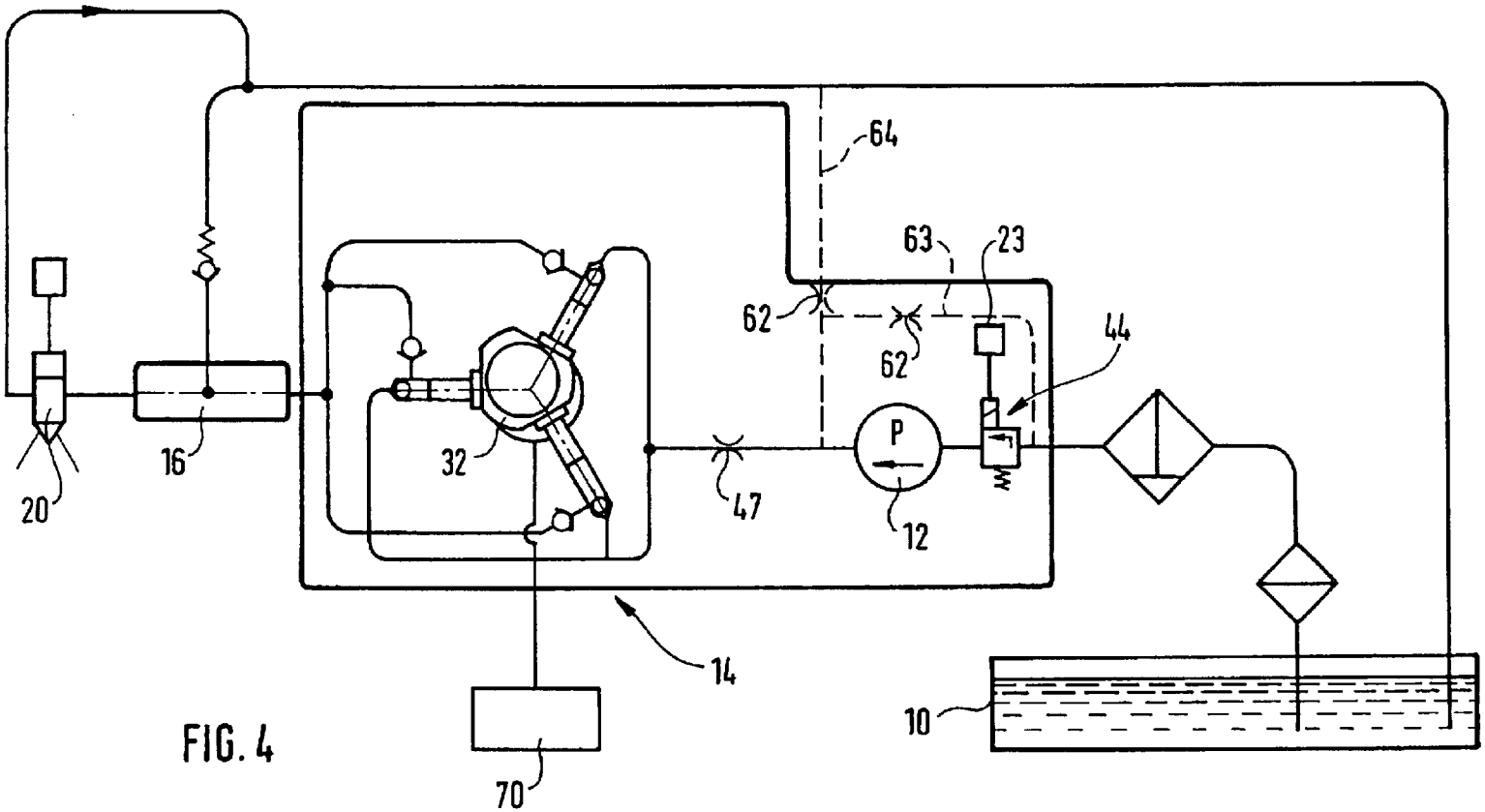
FIG. 4 schematically shows a fuel injection system for an internal combustion engine, in accordance with a fourth exemplary embodiment.

In a fourth exemplary embodiment of the fuel injection system, shown in FIG. 4, its drive region having the camshaft 32 is connected to a lubricant oil circulation 70 of the engine and is lubricated in that way. In that case, the pressure valve 48 with the downstream throttle restriction 52 is dispensed with. If the inlet to the prefeed pump 12 cannot be blocked completely by the fuel metering device 44, then as in the second or third exemplary embodiment, the communication with a relief region having the further throttle restriction 62 may be provided, which can be disposed in a connection 64 with a relief region into the fuel tank 10 or in a connection 63 with the intake side of the prefeed pump 12.

The foregoing relates to preferred exemplary embodiments of the invention, it being understood that other variants and embodiments thereof are possible within the spirit and scope of the invention, the latter being defined by the appended claims.

We claim:

1. A fuel injection system for an internal combustion engine, comprising a fuel reservoir (16), a high-pressure fuel pump (14) by which fuel is pumped, as a function of engine operating parameters, into the fuel reservoir (16), a prefeed pump (12) by which fuel is pumped out of a fuel tank (10) to the intake side of the high-pressure fuel pump (14), a fuel metering device (44) for adjusting the fuel quantity pumped by the high-pressure fuel pump (14) into the fuel reservoir (16), and at least one injector (20), communicating with the fuel reservoir (16), for injecting fuel to the engine, the metering device (44) being disposed between the fuel tank (10) and the intake side of the prefeed pump (12).

2. The fuel injection system according to claim 1 wherein the metering device (44) comprises an electromagnetically actuated flow regulating valve (46).

3. The fuel injection system according to claim 1 further comprising a connection containing a throttle restriction (54; 62) branching off to a relief region between the prefeed pump (12) and the high-pressure fuel pump (14).

4. The fuel injection system according to claim 2 further comprising a connection containing a throttle restriction (54; 62) branching off to a relief region between the prefeed pump (12) and the high-pressure fuel pump (14).

5. The fuel injection system according to claim 3 wherein the throttle restriction (54) is disposed in a connection (50) to a drive region (32) of the high-pressure fuel pump (14) as a relief region.

6. The fuel injection system according to claim 4 wherein the throttle restriction (54) is disposed in a connection (50) to a drive region (32) of the high-pressure fuel pump (14) as a relief region.

7. The fuel injection system according to claim 3 wherein the throttle restriction (62) is disposed in a connection (63) to the intake side of the prefeed pump (12) as a relief region.

8. The fuel injection system according to claim 4 wherein the throttle restriction (62) is disposed in a connection (63) to the intake side of the prefeed pump (12) as a relief region.

9. The fuel injection system according to claim 1 wherein the high-pressure fuel pump (14) has a drive region (32), which can be made to communicate, for the sake of its lubrication, with the outlet of the prefeed pump (12) via a pressure valve (48) that opens toward the drive region (32).

10. The fuel injection system according to claim 2 wherein the high-pressure fuel pump (14) has a drive region (32), which can be made to communicate, for the sake of its lubrication, with the outlet of the prefeed pump (12) via a pressure valve (48) that opens toward the drive region (32).

11. The fuel injection system according to claim 3 wherein the high-pressure fuel pump (14) has a drive region (32), which can be made to communicate, for the sake of its lubrication, with the outlet of the prefeed pump (12) via a pressure valve (48) that opens toward the drive region (32).

12. The fuel injection system according to claim 5 wherein the high-pressure fuel pump (14) has a drive region (32), which can be made to communicate, for the sake of its lubrication, with the outlet of the prefeed pump (12) via a pressure valve (48) that opens toward the drive region (32).

13. The fuel injection system according to claim 7 wherein the high-pressure fuel pump (14) has a drive region (32), which can be made to communicate, for the sake of its lubrication, with the outlet of the prefeed pump (12) via a pressure valve (48) that opens toward the drive region (32).

14. The fuel injection system according to claim 9 further comprising a throttle restriction (52), in an inlet (50) to the drive region (32) downstream of the pressure valve (48).

15. The fuel injection system according to claim 1 further comprising a return line (24) to the fuel tank (10) from the at least one injector (20), the return (24) discharging into a drive region (32) of the high-pressure fuel pump (14) and leading from that region to the fuel tank (10).

16. The fuel injection system according to claim 2 further comprising a return line (24) to the fuel tank (10) from the at least one injector (20), the return (24) discharging into a drive region (32) of the high-pressure fuel pump (14) and leading from that region to the fuel tank (10).

17. The fuel injection system according to claim 3 further comprising a return line (24) to the fuel tank (10) from the at least one injector (20), the return (24) discharging into a drive region (32) of the high-pressure fuel pump (14) and leading from that region to the fuel tank (10).

18. The fuel injection system according to claim 5 further comprising a return line (24) to the fuel tank (10) from the at least one injector (20), the return (24) discharging into a drive region (32) of the high-pressure fuel pump (14) and leading from that region to the fuel tank (10).

19. The fuel injection system according to claim 7 further comprising a return line (24) to the fuel tank (10) from the at least one injector (20), the return (24) discharging into a drive region (32) of the high-pressure fuel pump (14) and leading from that region to the fuel tank (10).

20. The fuel injection system according to claim 9 further comprising a return line (24) to the fuel tank (10) from the at least one injector (20), the return (24) discharging into a drive region (32) of the high-pressure fuel pump (14) and leading from that region to the fuel tank (10).

* * * * *